US010473075B2

(12) United States Patent
Kubota et al.

(10) Patent No.: US 10,473,075 B2
(45) Date of Patent: Nov. 12, 2019

(54) FUEL RAIL AND METHOD OF MANUFACTURING SAME

(71) Applicant: HITACHI AUTOMOTIVE SYSTEMS, LTD., Hitachinaka-shi, Ibaraki (JP)

(72) Inventors: Eiichi Kubota, Hitachinaka (JP); Koji Harada, Hitachinaka (JP); Keiichi Uraki, Hitachinaka (JP); Shinya Nakatani, Hitachinaka (JP); Hiroshi Ono, Hitachinaka (JP); Masahiro Soma, Hitachinaka (JP)

(73) Assignee: HITACHI AUTOMOTIVE SYSTEMS, LTD., Hitachinaka-Shi, Ibaraki (JP)

( * ) Notice: Subject to any disclaimer, the term of this patent is extended or adjusted under 35 U.S.C. 154(b) by 2 days.

(21) Appl. No.: 15/546,449

(22) PCT Filed: Jan. 12, 2016

(86) PCT No.: PCT/JP2016/050602
§ 371 (c)(1),
(2) Date: Jul. 26, 2017

(87) PCT Pub. No.: WO2016/121473
PCT Pub. Date: Aug. 4, 2016

(65) Prior Publication Data

US 2018/0274507 A1 Sep. 27, 2018

(30) Foreign Application Priority Data

Jan. 30, 2015 (JP) ..... 2015-016297

(51) Int. Cl.
*F02M 55/02* (2006.01)

(52) U.S. Cl.
CPC ..... *F02M 55/025* (2013.01); *F02M 55/02* (2013.01); *F02M 2200/80* (2013.01); *F02M 2200/8069* (2013.01)

(58) Field of Classification Search
CPC ..... F02M 55/025; F02M 2200/8069
See application file for complete search history.

(56) References Cited

U.S. PATENT DOCUMENTS 5,121,731 A * 6/1992 Jones ..... F02M 69/465 123/468
5,390,638 A * 2/1995 Hornby ..... F02M 51/005 123/456

(Continued)

FOREIGN PATENT DOCUMENTS

EP 2 667 011 A2 11/2013
JP H03-043574 U1 4/1991

(Continued)

OTHER PUBLICATIONS

Japanese Office Action and its English translation thereof issued in corresponding application No. 2016-571907 dated May 15, 2018.

(Continued)

*Primary Examiner* — Joseph J Dallo
(74) *Attorney, Agent, or Firm* — Foley & Lardner LLP

(57) ABSTRACT

An objective of the present invention is to provide a fuel rail that can be used at a high fuel pressure of 50 MPa or more, for example, has good engine mountability, and has improved material yield. The present invention is regarding a fuel rail including a main pipe portion 10 extending in a longitudinal direction and a plurality of distribution pipe portions 20*a*, 20*b*, 20*c*, and 20*d* branching from the main pipe portion in a cross direction, in a fuel supply system in which a fuel compressed by a fuel pump passes through a fuel passage hole of the fuel rail fixed to an engine trough a bracket or a stay, the fuel is supplied to injectors, and the fuel (Continued)

is injected into the engine, the present invention is to cut and form the main pipe portion 10 and the plurality of distribution pipe portions 20*a,* 20*b,* 20*c*, and 20*d* from a same single-sheet plate 100, the single-sheet plate being a plane plate or a flat plate having an irregular shape in cross section, and to seamlessly configure a main pipe hole 11, distribution pipe holes 21*a,* 21*b,* 21*c*, and 21*d*, and injector attaching holes 22*a,* 22*b,* 22*c*, and 22*d*, without joints.

5 Claims, 8 Drawing Sheets

(56) References Cited

U.S. PATENT DOCUMENTS

| | | | | |
|---|---|---|---|---|
| 6,405,712 | B1 | 6/2002 | Nomura | |
| 2004/0118382 | A1* | 6/2004 | Usui | F02M 55/004 123/456 |
| 2005/0188956 | A1 | 9/2005 | Moschini et al. | |
| 2005/0284447 | A1* | 12/2005 | Usui | F02M 55/005 123/468 |
| 2011/0108005 | A1* | 5/2011 | Nishizawa | F02M 55/025 123/469 |

FOREIGN PATENT DOCUMENTS

| | | | | |
|---|---|---|---|---|
| JP | 2001-159380 | A | | 6/2001 |
| JP | 2001-295723 | A | | 10/2001 |
| JP | 2007016668 | A | * | 1/2007 |
| JP | 2007-127062 | A | | 5/2007 |
| JP | 2008-298061 | A | | 12/2008 |
| JP | 2011-226353 | A | | 11/2011 |
| WO | WO-92/00451 | A1 | | 1/1992 |

OTHER PUBLICATIONS

Extended European Search Report dated Jul. 20, 2018 in corresponding application No. 16743077.

* cited by examiner

FUEL RAIL AND METHOD OF MANUFACTURING SAME

TECHNICAL FIELD

The present invention relates to a fuel rail that supplies a fuel compressed by a pump to injectors.

BACKGROUND ART

Fuel rails include a low-price type configured such that a plurality of distribution pipes is brazed to a hollow pipe, as a typical low-pressure fuel rail. Further, the fuel rails include an integrated type configured such that an external shape is molded by hot forging and a fuel passage is then drilled, as a high-pressure fuel rail. The integrated type typically has high durability but an external shape has unevenness specific to the forging, and material yield is low and the cost tends to increase.

CITATION LIST

Patent Literature

PTL 1: JP 2001-295723 A

SUMMARY OF INVENTION

Technical Problem

Therefore, an objective of the present invention is to provide a fuel rail that can be used at a high fuel pressure of 50 MPa or more, for example, has good engine mountability, and has improved material yield, and a method of manufacturing the fuel rail.

Solution to Problem

A fuel rail includes: a main pipe portion extending in a longitudinal direction; and a plurality of distribution pipe portions branching from the main pipe portion, the main pipe portion and the distribution pipe portions being cut and formed from a single-sheet plate, the single-sheet plate having a planar or flat shape, and a fuel passage connecting a main pipe hole, distribution pipe holes, and injector attaching holes being seamlessly configured without joints, the main pipe hole penetrating the main pipe portion, the distribution pipe holes respectively penetrating the plurality of distribution pipe portions, and the injector attaching holes being for attaching injectors.

Advantageous Effects of Invention

According to the present invention, the fuel rail can be used at a high fuel pressure of 50 MPa or more, for example, has good engine mountability, and has improved material yield.

Problems, configurations, and effects other than those described above will become apparent from the description of embodiments below.

DESCRIPTION OF EMBODIMENTS

Figure 1:
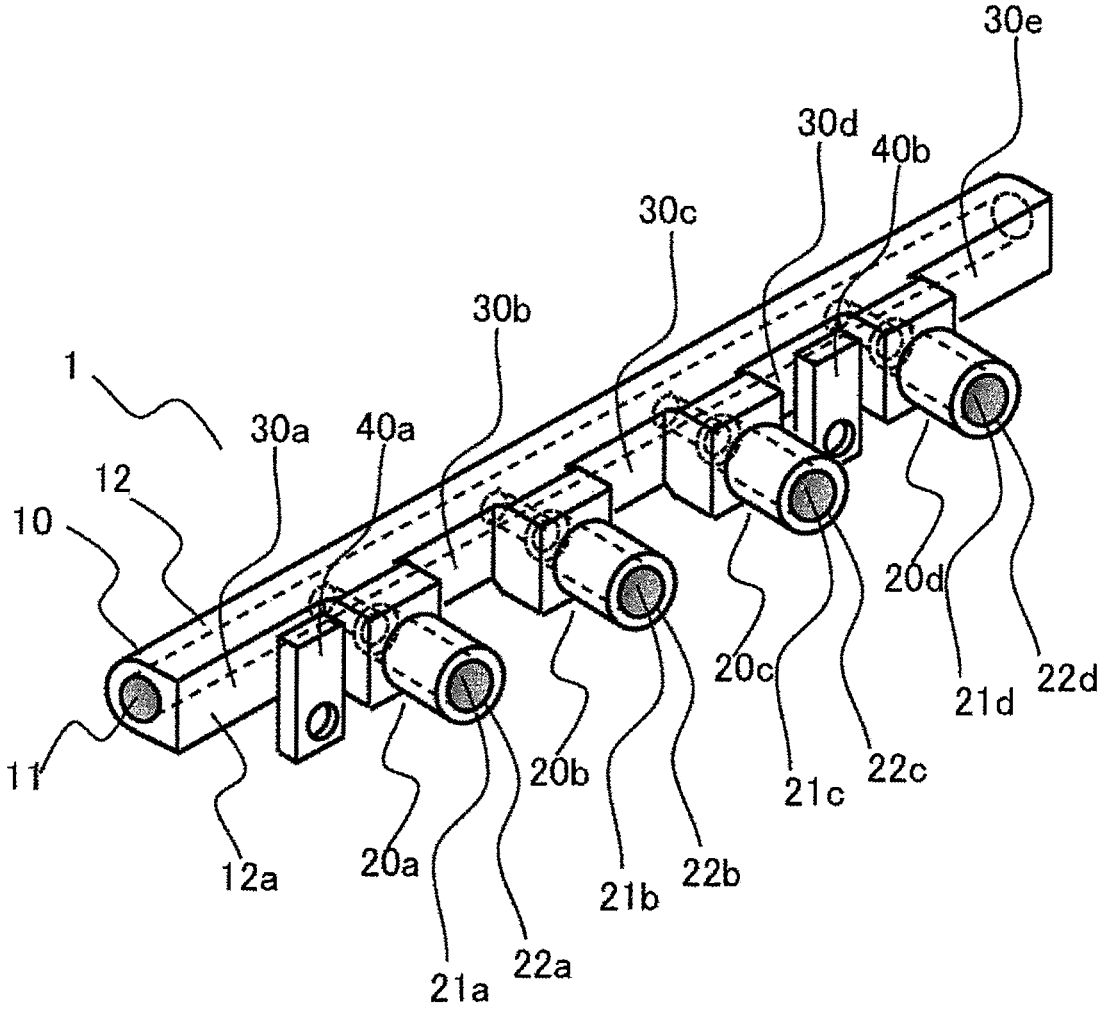
FIG. 1 is an external view of a fuel rail.

Hereinafter, the present invention will be described in detail.

The present invention is regarding a fuel rail including a main pipe portion extending in a longitudinal direction and a plurality of distribution pipe portions branching from the main pipe portion in a cross direction, in a fuel supply system in which a fuel compressed by a fuel pump passes through a fuel passage hole of the fuel rail fixed to an engine trough a bracket or a stay, the fuel is supplied to injectors, and the fuel is injected into the engine, the present invention is to cut and form the main pipe portion and the plurality of distribution pipe portions from a same single-sheet plate, the single-sheet plate being a plane plate or a flat plate having an irregular shape in cross section, and to seamlessly configure a main pipe hole, distribution pipe holes, and injector attaching holes without joints.

The present invention is, in a fuel rail including a main pipe portion extending in a longitudinal direction, and a plurality of distribution pipe portions branching from the main pipe portion in a cross direction, to cut the main pipe portion and the distribution pipe portions from the same single-sheet plate by a method such as laser cutting, abrasive water jet, wire electric discharge, wire saw machining, end milling, or press cutting, the single-sheet plate being a plane plate or a flat plate having an irregular shape in cross section, and to form a fuel passage hole extending long in an axial direction in a center of the main pipe portion by gun drill machining, boring machining, or the like, and fuel passage holes of the distribution pipe portions and injector attaching holes branching from the fuel passage hole with a drill, an end mill, a reamer, or by boring machining, to seamlessly configure a fuel passage portion made of the main pipe hole, the distribution pipe holes, and the injector attaching holes in the fuel rail without joints.

According to the above configuration, the fuel rail is cut from the single-sheet plate, and the fuel passage is seamlessly formed. Therefore, a fuel rail that has no joints and can stand a high fuel pressure of 50 MPa or more, for example, can be realized. Further, the plane plate or the flat plate is manufactured while internal quality is sufficiently controlled from a refinement stage of a material. Therefore, there are no internal defects, reliability is high, and an inspection process such as nondestructive inspection after manufacturing can be omitted, as compared with conventional hot forging methods and the like. Further, a rolled plate material has improved strength and can be thinned in design of the fuel rail, and has an advantage of weight reduction.

Further, by use of the plane plate or the flat plate, a fuel rail having a thin thickness direction and a constant dimension can be obtained, and mountability to a narrow portion of an engine is improved. Further, an attaching space to the engine can be made small, thereby to contribute to downsizing of the engine.

Further, the bracket or the stay is provided to the fuel rail, which is used to fix the fuel rail to the engine. Both surfaces of the plate material of the single-sheet plate have better surface roughness and are more stable than a forged surface and the like. The bracket or the stay can be directly fixed to the surfaces in a precise manner, and machining of an attaching surface can be omitted.

Further, in addition to the above, an outer peripheral side surface on a side facing a distribution pipe side, of an outer peripheral side surface of the main pipe portion, is configured from a plane surface in a roughly perpendicular relationship to an axial center of the distribution pipe portion. The distribution pipe is formed in a comb-like manner.

According to the above configuration, a surface facing the distribution pipe side, of the outer peripheral side surface of the main pipe portion, is configured from the plane surface. Therefore, weight reduction of the fuel rail can be achieved and strength against torsion and bending can be secured. In details, to achieve the weight reduction of the fuel rail, it is favorable to include a thinned and weight-reduced portion having an R-chamfered shape, a C-chamfered shape, a tapered shape, or a combined shape of the aforementioned shapes, between a surface on an opposite side of the distribution pipe portions, and both-side surfaces extending to the surface, of the outer peripheral side surface of the main pipe portion of the fuel rail. On the other hand, to suppress a decrease in the strength, it is effective to leave, in a plane surface manner, a surface facing the distribution pipe side, which is closest to the distribution pipe side to which injectors are attached, of the outer peripheral side surface of the main pipe portion.

Further, as another effect, the plane surface can be used as a reference surface in production, and high precision of passage hole machining and injector attaching hole machining, highly precise positioning in assembly processes of injectors and the like, fall prevention, speed-up of conveyance, simplification of package at the time of shipment of a finished product, and compat packing can be achieved.

Further, a fuel rail in which the surface facing the distribution pipe side, of the outer peripheral side surface of the main pipe portion, is the plane surface and the thinned and weight-reduced portion is provided on the opposite side of the plane surface, and a section of the main pipe portion is made asymmetric, has an effect to reduce vibration noise at the time of practical use. Further, as another effect of the asymmetric section shape of the main pipe portion, the thinned and weight-reduced portion mainly bears expansion deformation when a high pressure is applied to the fuel rail, and thus the plane surface side has small deformation and excessive bending stress is not applied to the injectors, and the thinned and weight-reduced portion side also serves a function to reduce pulsation of the fuel pressure by an accumulator effect.

Further, in addition to the above description, the outer peripheral side surface on a side facing the distribution pipe side, of the outer peripheral side surface of the main pipe portion, is configured from a wave surface in a parallel relationship to a virtual plane surface in a perpendicular relationship to an axial center of the distribution pipe portion.

According to the above configuration, the wave surface has an effect to radiate heat, which is generated in a state of practical use of the fuel rail, in addition to the above effects.

Further, a method of manufacturing the fuel rail is to use a long and narrow plane plate in a relationship of the width <the thickness<the length, or a flat single-sheet plate having an irregular shape in cross section, and to alternately lay out and cut the plate material in a teeth with gaps manner (comb-like manner) such that both sides in a width direction of the plate material become the main pipe portions of the fur rails and a portion between the main pipe portions becomes the distribution pipe portions, to cut at least one set or more of the fuel rails.

According to the above configuration, the plate material is alternately laid out and cut in a teeth with gaps manner (comb-like manner) such that the both sides in the width direction of the long and narrow plate material become the main pipe portions of the fur rails, and the portion between the main pipe portions becomes the distribution pipe portions, and at least one set or more of the fuel rails is cut. Therefore, material yield is particularly improved. Accordingly, productivity of the fuel rail is dramatically improved, and the fuel rail that can be used for a high fuel pressure and is also low cost can be realized.

Hereinafter, embodiments according to the present invention will be described with reference to the drawings.

First Embodiment

FIG. 1 is an external view of a fuel rail of an embodiment of the present invention. A fuel rail 1 consists of a main pipe portion 10 extending in a longitudinal direction, and a plurality of distribution pipe portions 20*a*, 20*b*, 20*c*, and 20*d* branching from the main pipe portion 10 in a cross direction. A main pipe hole 11 is formed inside the main pipe portion 10, and distribution pipe holes 21*a*, 21*b*, 21*c*, and 21*d*, and injector attaching holes 22*a*, 22*b*, 22*c*, and 22*d* are respectively formed inside the distribution pipe portions 20*a*, 20*b*, 20*c*, and 20*d*. Further, the main pipe hole 11, the distribution pipe holes 21*a*, 21*b*, 21*c*, and 21*d*, and the injector attaching holes 22*a*, 22*b*, 22*c*, and 22*d* constitute a communicating fuel passage, and the fuel passage portion of these holes forms a seamless structure without joints. Further, brackets 40*a* and 40*b* for fixing the fuel rail 1 to an engine are attached to the fuel rail 1. Further, a main pipe portion outer peripheral side surface 12*a* on aside facing the distribution pipe portions 20*a*, 20*b*, 20*c*, and 20*d*, of a main pipe portion outer peripheral side surface 12, is configured from a plane surface, and a surface on an opposite side of the main pipe portion outer peripheral side surface 12*a* across the main pipe hole 11 is formed into an arc shape and is configured to be a thin wall.

Figure 2:
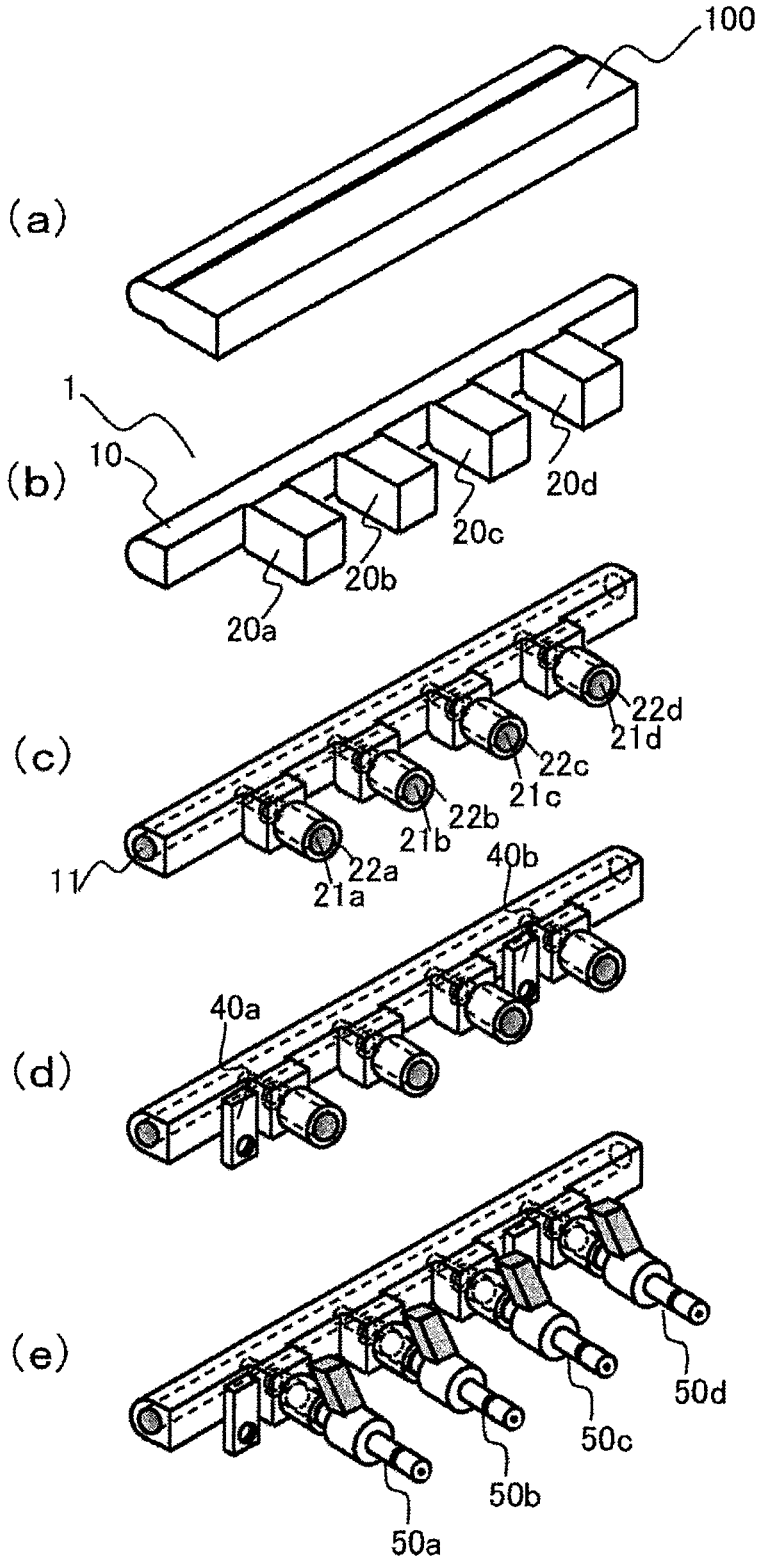
FIGS. 2(*a*) to 2(*e*) are explanatory views illustrating a method of manufacturing the fuel rail.

FIGS. 2(*a*) to 2(*e*) are explanatory views illustrating a method of manufacturing the fuel rail 1 illustrated in FIG. 1. FIG. 2(*a*) illustrates a single-sheet plate of a material. In this example, a flat single-sheet plate 100 with one side having has an arc shape, and steps in a plate thickness direction, is used. As a method of producing this material, a drawing method, an extrusion method, or the like can be employed.

FIG. 2(*b*) is a next process, illustrating a state in which the main pipe portion 10 and the distribution pipe portions 20*a*, 20*b*, 20*c*, and 20*d* are integrally cut from the flat plate 100 having an irregular shape in cross section. As a cutting method, laser cutting or abrasive water jet is appropriate in terms of speed. However, the flat plate 100 can be cut by a method such as wire electric discharge, wire saw machining, end milling, or press cutting.

FIG. 2(*c*) is a next process, illustrating a state in which the main pipe hole 11, the distribution pipe holes 21*a*, 21*b*, 21*c*, and 21*d*, the injector attaching holes 22*a*, 22*b*, 22*c*, and 22*d*, and the like are machined. In this case, the main pipe hole 11 is machined by gun drill machining, boring machining, or the like, and the distribution pipe holes 21*a*, 21*b*, 21*c*, and 21*d*, the injector attaching holes 22*a*, 22*b*, 22*c*, and 22*d*, and the like are machined with a drill, an end mill, or a reamer.

Especially, a boring method by a U-axis machining center can perform recess machining and can machine smooth holes.

FIG. 2(*d*) illustrates a state in which the engine attaching brackets 40*a* and 40*b* are attached to the outer peripheral side surface 12 of the main pipe portion 10 of the fuel rail 1. In this example, the bracket 40*a* is positioned between the plane surface 30*a* and the distribution pipe portion 20*a*, and the bracket 40*b* is positioned between the plane surface 30*d* and the distribution pipe portion 20*d*. Examples of a method of joining the brackets include projection welding, another welding, and a brazing method.

FIG. 2(*e*) illustrates a state in which injectors 50*a*, 50*b*, 50*c*, and 50*d* are attached to the injector attaching holes 22*a*, 22*b*, 22*c*, and 22*d* of the fuel rail 1.

According to the present embodiment, the fuel rail 1 is cut from the single-sheet plate, and the fuel passage is seamlessly formed. Therefore, the fuel rail 1 that has no joints and can stand a high fuel pressure of 50 MPa or more, for example, can be realized. Further, flat plate 100 is manufactured while internal quality of the material is sufficiently controlled up to a row material molding stage of the material. Therefore, there are no internal defects, reliability is high, and an inspection process such as nondestructive inspection after manufacturing can be omitted. Further, a molded plate material typically has improved strength and can be thinned in design of the fuel rail 1 and can reduce the weight.

Further, the surface on the side facing the side of the distribution pipe sides 20*a*, 20*b*, 20*c*, and 20*d*, of the outer peripheral side surface 12 of the main pipe portion 10, is configured from the plane surface 12*a*, and the opposite surface is configured in an arc manner. Therefore, the weight reduction of the fuel rail can be achieved, and the strength against torsion and bending can be secured.

Further, the plane surface 12*a* can be used as a reference surface in production, high precision of passage hole machining and injector attaching hole machining, highly precise positioning in assembly processes of injectors and the like, fall prevention, speed-up of conveyance, simplification of package at the time of shipment of a finished product, and compact packing can be achieved.

Further, the surface facing the side of the distribution pipe sides 20*a*, 20*b*, 20*c*, and 20*d*, of the outer peripheral side surface 12 of the main pipe portion 10, is the plane surface 12*a*, and the opposite side is provided with an arc portion (thinned and weight-reduced portion), to make the section of the main pipe portion asymmetric. Therefore, the effect to reduce vibration noise at the time of practical use of the fuel rail 1 is exhibited. Further, as another effect of the asymmetric section shape of the main pipe portion 10, the arc portion (thinned and weight-reduced portion) mainly bears expansion deformation when a high pressure is applied to the fuel rail, and thus the plane surface 12*a* side has small deformation and excessive bending stress is not applied to the injectors, and the arc portion (thinned and weight-reduced portion) side also serves a function to reduce pulsation of the fuel pressure by an accumulator effect.

Second Embodiment

Figure 3:
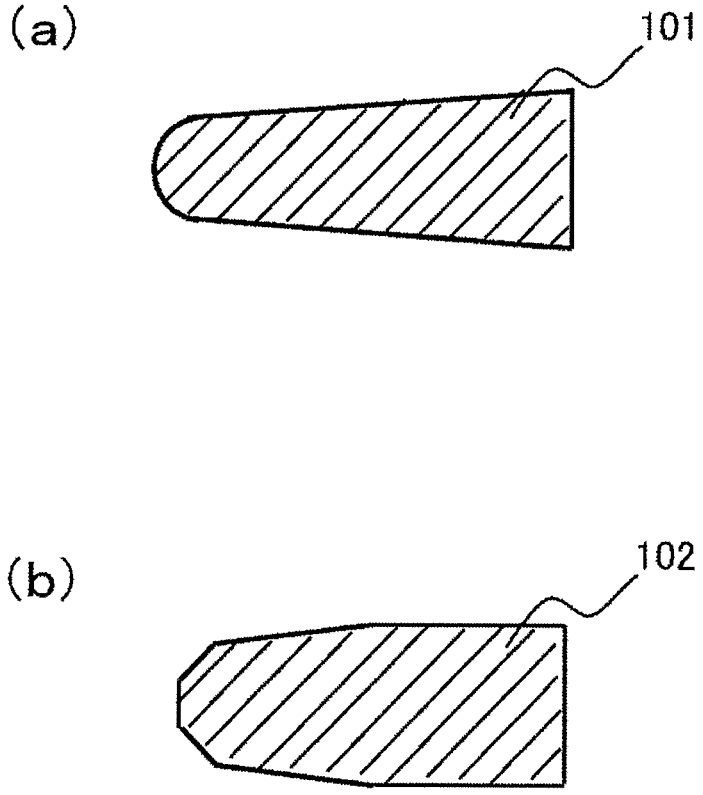
FIGS. 3(*a*) and 3(*b*) are cross sectional views of a single-sheet plate that is a material of a fuel rail.

FIGS. 3(*a*) and 3(*b*) illustrate another embodiment of a flat plate of a material of a fuel rail 1, illustrating shapes of cross sections of a single-sheet plate.

In the present embodiment, the material can be molded by an extrusion or drawing method. Therefore, the degree of freedom of the cross section shape is high, and optimization in design can be achieved.

Third Embodiment

Figure 4:
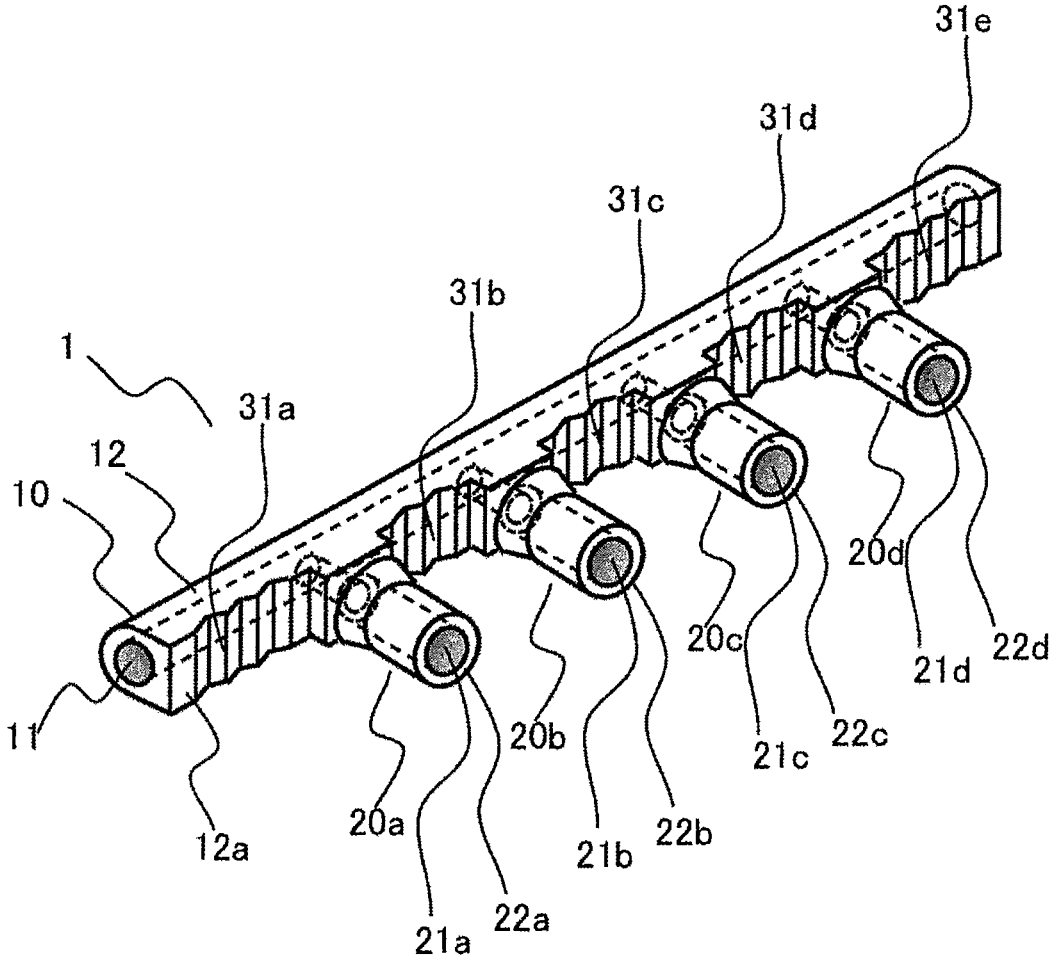
FIG. 4 is an external view of a fuel rail.

FIG. 4 illustrates another embodiment, in which a main pipe portion outer peripheral side surface 12*a* on a side facing distribution pipe portions 20*a*, 20*b*, 20*c*, and 20*d*, of a main pipe portion outer peripheral side surface 12 of a main pipe portion 10 of a fuel rail 1, is configured from wave surfaces 31*a*, 31*b*, 31*c*, 31*d*, and 31*e* in a parallel relationship to the plane surfaces 30*a*, 30*b*, 30*c*, 30*d*, and 30*e* of the first embodiment, in place of the plane surfaces 30*a*, 30*b*, 30*c*, 30*d*, and 30*e*.

In the present embodiment, the wave surfaces can serve a function to radiate heat, which is generated in a state of practical use of the fuel rail, in addition to the above-described effects. Especially, generation of heat is increased as a fuel pressure becomes higher, and thus this method is effective. Further, according to the manufacturing method of the present embodiment, the wave surfaces can be relatively easily formed by a cutting method.

Fourth Embodiment

Figure 5:
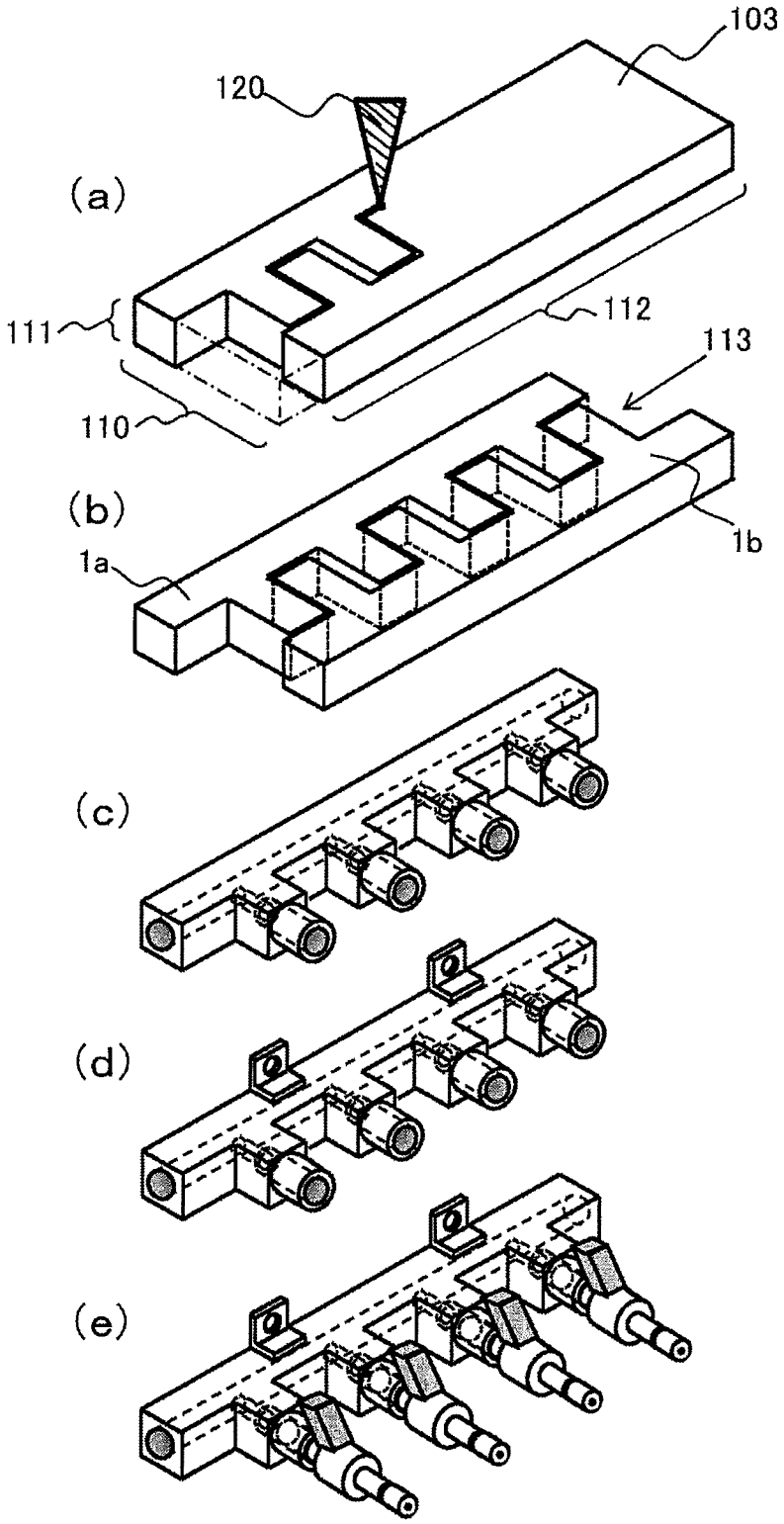
FIGS. 5(*a*) to 5(*e*) are explanatory views illustrating a method of manufacturing a fuel rail.

FIGS. 5(*a*) to 5(*e*) illustrates an embodiment, illustrating another method of manufacturing a fuel rail 1, in which two fuel rails 1*a* and 1*b* are cut from one long and narrow plane plate 103. FIG. 5(*a*) illustrates a plate width 110, a plate thickness 111, and a plate length 112. Respective main pipe portions 10 are taken from both sides of the plate width 110 of the plane plate 103, and a portion between the main pipe portions 10 is cut in a zigzag teeth with gaps manner 113, so that respective distribution pipe portions 20*a*, 20*b*, 20*c*, and 20*d* are integrally cut with the main pipe portions 10. Further, in this embodiment, a laser cutting method is employed. As the plate width 110 and the plate thickness 111 of the single-sheet plate 103, surfaces at the time of extruding the material are use as they are, and only a vicinity of the center of the plate width 110 is cut with a laser light 120.

According to this method, material yield is particularly improved, a cut distance is short and can be cut in a short time, and bending of the material due to thermal effect at the time of cutting is small. According to this method, productivity of the fuel rail 1 is dramatically improved, and the fuel rail 1 that can be used for a high fuel pressure and is also low cost can be realized.

Further, brackets 40*a* and 40*b* for fixing the fuel rail 1 to an engine are attached to the fuel rail 1. The both surfaces of the plate material 103 of the single-sheet plate have good surface roughness and are stable, and the brackets can be precisely fixed without applying additional machining to the surface.

Fifth Embodiment

Figure 6:
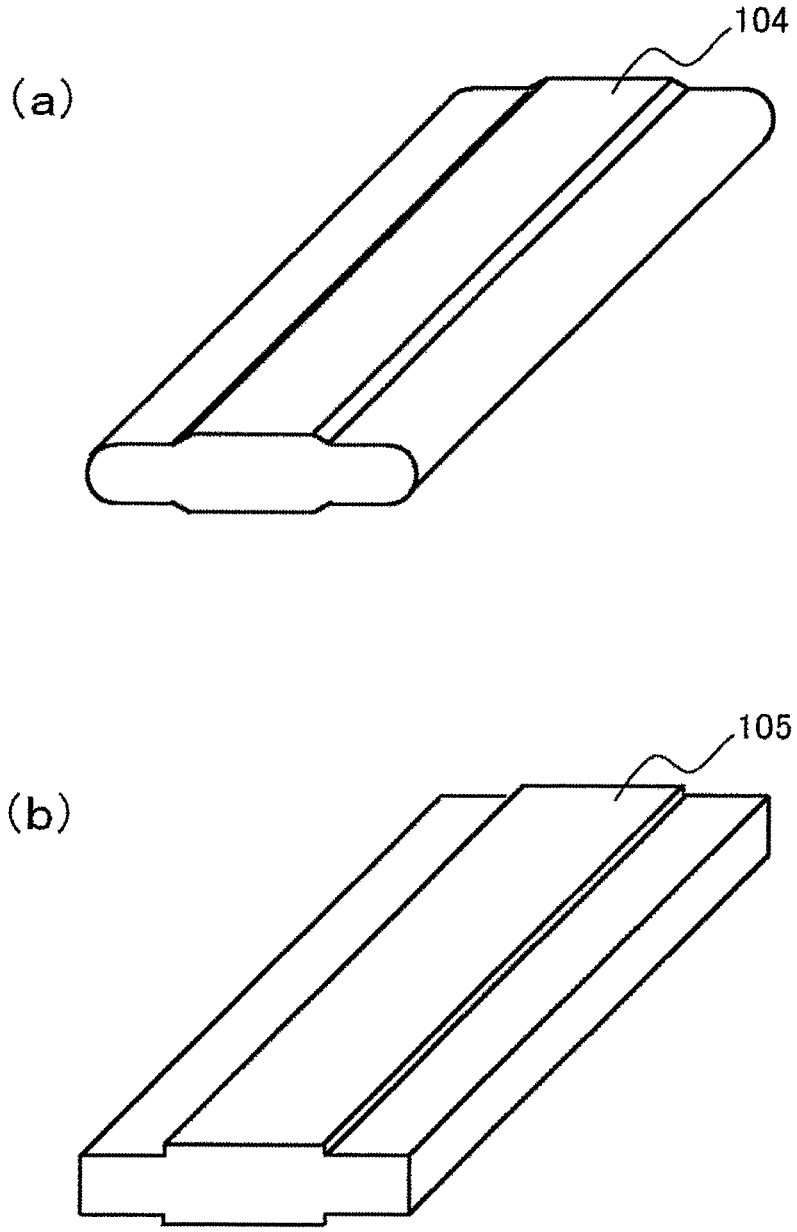
FIGS. 6(*a*) and 6(*b*) are external views of a single-sheet plate that is a material of a fuel rail.

FIGS. 6(*a*) and 6(*b*) illustrates an embodiment using a flat plate 104 or 105 having an irregular shape in cross section, in place of the plane plate 103 of FIGS. 5(*a*) to 5(*e*). Injector attaching holes 22*a*, 22*b*, 22*c*, and 22*d* are configured in distribution pipe portions 20*a*, 20*b*, 20*c*, and 20*d* of a fuel rail 1, and thus a thickness of the size of the injector attaching holes is necessary. On the other hand, a main pipe portion 10 is favorably as thin as possible for weight reduction. Therefore, in this embodiment, the thickness of the flat plate 104 or 105 is provided with steps at a material drawing stage, between both end portions of the plate width, which serve as the main pipe portions 10, and a central portion that serves as the distribution pipe portions 20*a*, 20*b*, 20*c*, and 20*d*. Further, in the case of FIG. 6(*a*), outer peripheral side surfaces on opposite sides of the distribution pipe portions, of outer peripheral side surfaces 12 of the fuel rails 1, are formed into arch shapes, thereby to give consideration to further weight reduction and simplification of handling.

Sixth Embodiment

Figure 7:
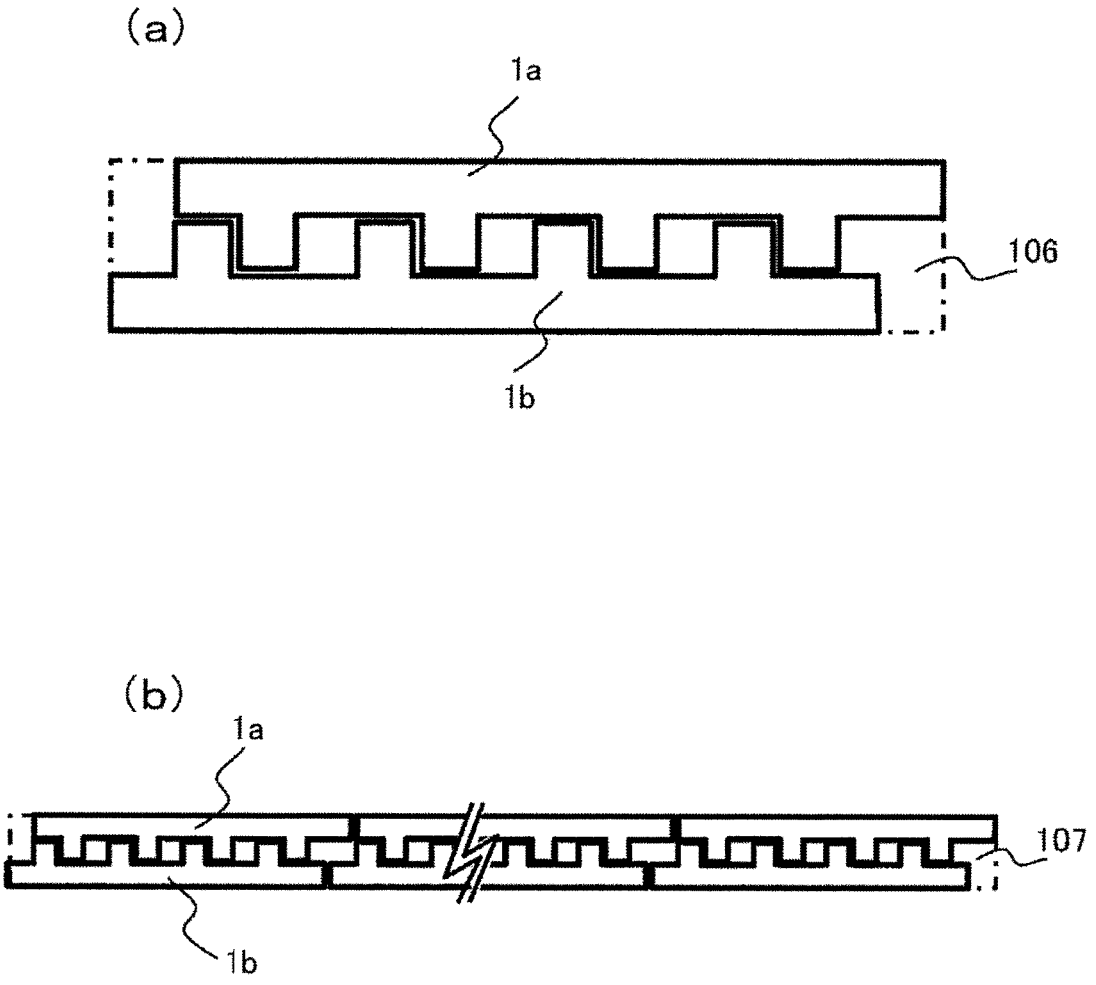
FIGS. 7(*a*) and 7(*b*) are explanatory views illustrating a cutting layout of fuel rails.

FIGS. 7(*a*) and 7(*b*) are explanatory views illustrating cutting layouts of fuel rails. FIG. 7(*a*) illustrates a case in which two fuel rails 1*a* and 1*b* are cut from a single-sheet plate 106, and FIG. 7(*b*) illustrates a case in which ten fuel rails are cut from a longer and narrower single-sheet plate 107. A result of material yield of 82% in the case of FIG. 7(*a*), and a result of material yield of 90% in the case of FIG. 7(*b*) can be obtained. In the case of FIG. 7(*b*), a cut portion on one side in a length direction of the case of FIG. 7(*a*) is used for the next arrayed fuel rail, whereby the yield is improved.

Seventh Embodiment

Figure 8:
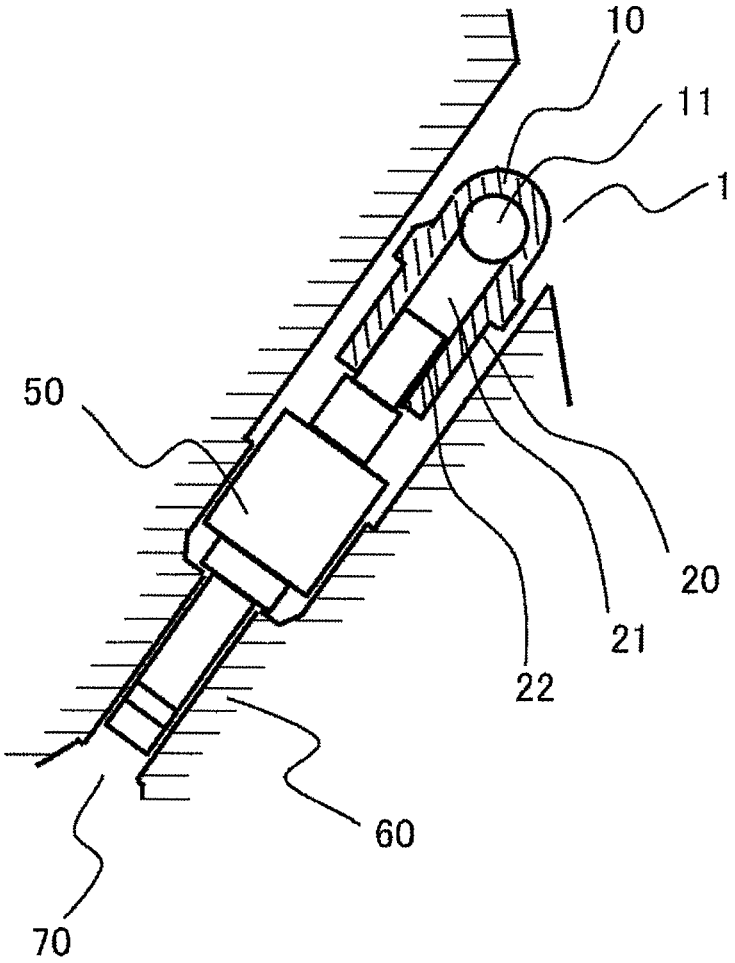
FIG. 8 is an explanatory view illustrating an attaching state of a fuel rail to an engine.

FIG. 8 is a diagram of a state in which a fuel rail 1 assembled with an injector 50 is incorporated into an engine block 60. According to the present embodiment, the fuel rail 1 is configured from a plane or flat single-sheet plate, and a fuel passage is seamlessly configured without joints. Therefore, attachability of the fuel rail 1 to the engine is improved. Further, an attaching space on the engine side can be narrowed, which can contribute to downsizing and weight reduction of the engine.

REFERENCE SIGNS LIST

1 fuel rail
10 main pipe portion
11 main pipe hole
12 main pipe portion outer peripheral side surface
20*a*, 20*b*, 20*c*, and 20*d* distribution pipe portion
21*a*, 21*b*, 21*c*, and 21*d* distribution pipe hole
22*a*, 22*b*, 22*c*, and 22*d* injector attaching hole
30*a*, 30*b*, 30*c*, 30*d*, and 30*e* plane surface portion
30*a* and 30*b* bracket
100 flat single-sheet plate
50*a*, 50*b*, 50*c*, and 50*d* injector
101 flat single-sheet plate
102 flat single-sheet plate
103 plane plate
31*a*, 31*b*, 31*c*, 31*d*, and 31*e* wave surface
110 plate width
111 plate thickness
112 plate length
113 teeth with gaps manner
120 laser light
104 flat single-sheet plate
105 flat single-sheet plate
106 flat single-sheet plate
107 flat single-sheet plate
60 engine block
70 engine inner cylinder

The invention claimed is:

1. A fuel rail comprising:

a main pipe portion including a main pipe hole extending in a longitudinal direction and penetrating the main pipe portion; and a distribution pipe portion including a distribution pipe hole branching from the main pipe hole and penetrating the distribution pipe portion, wherein the distribution pipe portion is formed as one member with the main pipe portion without a joint between a root portion of the distribution pipe portion and the main pipe portion, and the root portion of the distribution pipe portion is formed to have a square or rectangular section shape in a direction perpendicular to a direction that the distribution pipe hole penetrates.

2. The fuel rail according to claim 1, wherein a plurality of the distribution pipe portions is provided, and is formed in a comb-like manner in an outer peripheral side surface of the main pipe portion.

3. The fuel rail according to claim 2, wherein an outer peripheral side surface on a side where the distribution pipe side is formed, of the outer peripheral side surface of the main pipe portion, is a plane surface in a perpendicular relationship to an axial center of the distribution pipe portion.

4. A fuel rail comprising:

a main pipe portion including a main pipe hole extending in a longitudinal direction and penetrating the main pipe portion; and a distribution pipe portion including a distribution pipe hole branching from the main pipe hole and penetrating the distribution pipe portion, wherein the distribution pipe portion is formed as one member with the main pipe portion without a joint between a root portion of the distribution pipe portion and the main pipe portion, and the root portion of the distribution pipe portion is formed to have a square or rectangular section shape in a direction perpendicular to a direction that the distribution pipe hole penetrates, wherein an outer peripheral side surface on a side where the distribution pipe side is formed, of the outer peripheral side surface of the main pipe portion, is formed in a wave surface manner, the wave surface being displaced in an axial center direction of the distribution pipe portion as the wave surface progresses in the longitudinal direction of the main pipe portion.

5. A method of manufacturing a fuel rail provided with a main pipe portion including a main pipe hole extending in a longitudinal direction and penetrating the main pipe portion, and a plurality of distribution pipe portions including distribution pipe holes branching from the main pipe hole and penetrating the distribution pipe portions, the method comprising:

cutting and forming the main pipe portion and the plurality of distribution pipe portions from a planar or flat single-sheet plate, wherein the root portion of the distribution pipe portion cut from the single-sheet plate has a square or rectangular section shape in a direction perpendicular to a direction that the distribution pipe hole penetrates.

* * * * *